United States Patent [19]

Barrie et al.

[11] Patent Number: 4,495,414

[45] Date of Patent: Jan. 22, 1985

[54] AUTOMATIC MASS SPECTROMETER INLET SYSTEM

[75] Inventors: Andrew Barrie, Knutsford; Phillip A. Freedman, Northwich, both of England

[73] Assignee: V.G. Isogas Limited, England

[21] Appl. No.: 445,550

[22] Filed: Nov. 30, 1982

[30] Foreign Application Priority Data

Nov. 30, 1981 [GB] United Kingdom ..... 8136038

[51] Int. Cl.[3] ..... H01J 49/04

[52] U.S. Cl. ..... 250/288; 250/282

[58] Field of Search ..... 250/288, 282, 281

[56] References Cited

U.S. PATENT DOCUMENTS 3,194,054 7/1965 Deaton et al. ..... 73/25

3,662,588 5/1972 Emerson et al. ..... 73/23

OTHER PUBLICATIONS

Bridger et al., "New Mass Spectrometer . . . ", *Adv. in Mass Spec.*, 1975, 6, 365–375.

Herzog, "Performance of a New Mass Spectrometer . . . ", *21st Am. Conf. on Mass Spectrometry and Allied Topics*, San Francisco, 1973.

Roth, *Vacuum Technology*, 1976, 254–255.

Guthrie, *Vacuum Technology*, 1963, 132–138.

*Primary Examiner*—Bruce C. Anderson

*Assistant Examiner*—Jack I. Berman

*Attorney, Agent, or Firm*—Bacon & Thomas

[57] ABSTRACT

There is provided a mass spectrometer having a gas inlet system for introducing a sample into the ion source of the spectrometer which inlet system includes a cold trap for condensing a sample. The inlet system is provided with means for detecting the pressure therein and means for automatically controlling the operation of the cold trap in dependence on the detected pressure whereby the sample is automatically condensed in the cold trap when it is present in a small quantity. Around the cold trap is conveniently a coolant passage through which coolant from a coolant reservoir is drawn.

10 Claims, 4 Drawing Figures

AUTOMATIC MASS SPECTROMETER INLET SYSTEM

This invention relates to an automatic gas sampling inlet system for mass spectrometers, such as those intended for determining the isotopic composition of materials.

One method of determining the isotopic composition of a gas or vapour such as $CO_2$, $SO_2$, $O_2$, $H_2O$, etc. is to use a mass spectrometer which is specially constructed for the purpose. These are often small single focussing magnetic sector mass spectrometers which incorporate several fixed collectors, arranged for the simultaneous monitoring of the mass to charge ratios required, for example, 44, 45 and 46 in the case of an instrument intended for $CO_2$ analysis. In order to admit the sample of gas, a form of gas handling system is required. The simplest of these might consist of a reservoir vessel with an inlet valve which is connected to the spectrometer source by means of a capillary restriction, and a pump for evacuating the vessel when required. A second vessel containing the sample is connected to the inlet valve, and the reservoir vessel evacuated. The contents of the sample vessel are then expanded into the reservoir vessel, and commence to leak slowly into the spectrometer source through the capillary. The ratios of the intensities of the mass spectrometric peaks corresponding to the mass to charge ratios of interest are then measured in order to determine the isotopic composition of the material. To improve the accuracy, it is conventional to alternate the measurement of the unknown sample with that of a reference sample of accurately known composition, and this is frequently done by using a second, identical inlet system for the reference sample, switching between the two inlets by means of a low volume changeover valve when required. This valve may also be arranged to connect the sample not in use to a pumping system with the same pressure and pumping speed as the mass spectrometer source pumping system, so that the rate of depletion of both samples is the same, irrespective of which is flowing into the source, thereby avoiding a change in source pressure when the changeover valve is operated.

In order to equalise the pressures in the sample and reference systems before the measurements are started, a variable volume reservoir (e.g. a stainless steel bellows) is connected to each inlet system. A mechanism is provided to compress or extend the bellows, either manually or by means of an electric motor and a suitable mechanical linkage, so that the pressure in each inlet system can be adjusted to the desired value after the samples have been admitted. Once the bellows have been adjusted, they are isolated from the rest of the inlet system so that the volumes containing the reference and unknown samples are equal, and the isotopic ratio measurements made as described. By using an inlet system of this type, very accurate results can be obtained, and the entire sample handling routine, including the pressure equalizing technique, can be completely automated if remotely actuated valves are used, controlled by a suitably programmed digital computer. A large number of sample vessels may be connected to a manifold fitted with isolation valves controlled by the computer, so that many samples may be analysed without the need for operator intervention. Such automatic inlet systems are known, and will not be described in detail. They suffer, however, from the important defect that a certain minimum quantity of sample is required, generally about 0.1 at.cm$^3$, for their proper operation. This requirement is due to the minimum internal volume with which an inlet system of this type can be constructed; the sample gas must fill this volume so that the resultant pressure is large enough to ensure an adequate flow of sample into the source. If this flow is too low the mass spectrometer peaks will be less intense, and the accuracy of the measurements will be degraded because of the increased contribution of background noise from the mass spectrometer.

In the case of gaseous samples which can be condensed at atmospheric pressure, such as $CO_2$, $SO_2$, $H_2O$, etc., a better method of handling small quantities of samples is to condense all the available sample into a cooled low volume trap, e.g. 0.1 ccs capacity, to isolate this trap from the sample vessel, pump away any residual non-condensable gases, then connect the trap to the spectrometer inlet restriction, and allow it to warm up. The condensed sample will then vaporise in a much smaller volume than would otherwise be possible, and a higher flow rate into the source can be achieved, at least for a limited period of time. A similar treatment can be applied to the reference sample, and alternate measurements of the isotopic compositions made as previously described. In this way, samples of about 0.01 at.cm$^3$ can be handled, and although the results may not be as accurate as the conventional method used with samples of 0.1 at.cm$^3$ or more, they are considerably better than the results that would be obtained by trying to analyse small samples with the conventional method.

Consequently, there is advantage to be gained by combining a low volume cold trap with the conventional inlet system described, so that the range of acceptable sample sizes can be increased. A difficulty arises, however, in automating an inlet system of this type. It is relatively straightforward, using known techniques, to automate the conventional inlet system, but the construction of a completely automatic cold trap type of inlet system has not been described because of the need to provide at an economical cost, equipment for rapidly cooling and rapidly heating the trap, controlling its temperature, and for automatically detecting which mode of operation of the inlet system is required to suit the sample being analysed without further loss of sample. Known inlet systems therefore comprise a completely automatic conventional inlet system with an additional manually operated cold trap inlet system, which requires the spectrometer operator to heat and cool the trap, e.g. by immersing it in liquid nitrogen, at the appropriate time, as well as operating the various valves throughout the procedure for admitting the sample. It is an object of the present invention to provide an automatic cold trap type of inlet system which can be incorporated in an automatic conventional gas inlet system for an isotopic ratio mass spectrometer, and which can be constructed from relatively cheap components, and further, to provide a simple method of detecting which mode of operation of the inlet is required without loss of sample or any operator intervention.

According to one aspect of the invention, there is provided a mass spectrometer having a gas inlet system which includes a cold trap for condensing a sample, characterised in that said inlet system is provided with means for detecting the pressure in said inlet system and means for automatically controlling the operation of said cold trap in dependence on the detected pressure whereby the sample is automatically condensed in said cold trap when it is present in a small quantity.

The invention enables samples to be automatically analysed when some samples are present in sufficient quantity to be introduced into the mass spectrometer via the conventional inlet system whilst other samples are available in such small quantities that they should be introduced via the cold trap. When a small sample enters the inlet system its pressure will be relatively low and the system is preferably arranged such that when the detected pressure is below a predetermined level on the introduction of the sample the cold trap is automatically operated whilst when it is above the predetermined level the conventional inlet system is used. This may be achieved by providing the inlet system with means for by-passing the cold trap and means for selecting the inlet route by which a sample is admitted to the ion source of the spectrometer to involve either the means for by-passing the cold trap or the cold trap. The means for selecting automatically selects the inlet route to involve the means for by-passing the cold trap when either the detected pressure in the inlet system is greater than a predetermined value or the rate or extent of fall of the pressure in the inlet system whilst the cold trap is maintained at low temperature is greater than a predetermined value.

It sometimes happens that a sample vessel contains a relatively large mass of gas but only a small proportion of it is the relevant sample, the remainder being a non-condensable inert gas. Under these circumstances the cold trap should desirably be used, in effect to concentrate the sample. The invention provides the possibility of automatically detecting these circumstances by detecting the partial pressure of the sample. For example, the cold trap could be started routinely for all samples and the rate of fall of the pressure monitored. When the gas is largely the condensable sample the pressure will fall relatively rapidly and the conventional inlet system could be used. If the pressure falls relatively slowly, this indicates only a small proportion of sample and the cold trap would then automatically be operated. Thus the invention provides a mass spectrometer inlet system capable of fully unattended operation and capable of selecting automatically the cold trap or the conventional system.

Viewed from another aspect, the invention provides a mass spectrometer having an inlet system including a cold trap comprising a coolable vessel a coolant passage around said coolable vessel and means for drawing a coolant through said coolant passage from a coolant reservoir. In the preferred embodiment a coolant reservoir is connected to a coolant jacket around the coolable vessel and an outlet from the jacket is connected to a pump. The flow of coolant, and hence the operation of the cold trap, can be controlled simply by starting and stopping the pump. Alternatively, a control valve, e.g. a solenoid valve, may be installed between the pump and the outlet from the coolant jacket. The pump may then be continuously-running and the flow of coolant controlled by operating the valve. The coolant may be a liquefied gas, such as liquid nitrogen and it may be desirable to provide a heat exchanger between the jacket and the pump (or control valve, if provided) to prevent liquid coolant from reaching the valve and pump. This enables the use of simple and economical components for the valve and pump. The cold trap is preferably also provided with a heating means capable of heating the cold trap to at least 100° C., e.g. an electrical heater, and a temperature measuring means, such as a thermocouple. A known analogue temperature controller may be used to control the heater and solenoid valve in accordance with the sensed temperature to maintain a desired temperature of the cold trap.

Thus a simple and economical cold trap is provided which may be controlled automatically, e.g. by a suitably programmed microprocessor or digital computer. On receipt of a signal from the computer the controller causes the pump to be started, or opens the solenoid valve, so that coolant is drawn through the jacket until the desired temperature is reached. When it is desired to warm the trap to evaporate the sample, the pump is stopped, or the valve closed, and the heater is operated. The pump (or valve) and heater may then be operated to maintain the desired temperature. When it is desired to bake the trap to remove contamination, the heater alone is operated.

The cold trap of the invention is particularly valuable when it is used in combination with an automatic inlet system as defined above since it can of course be brought into operation automatically.

An embodiment of the invention will now be described by way of example and with reference to the accompanying drawings, in which.

Figure 1:
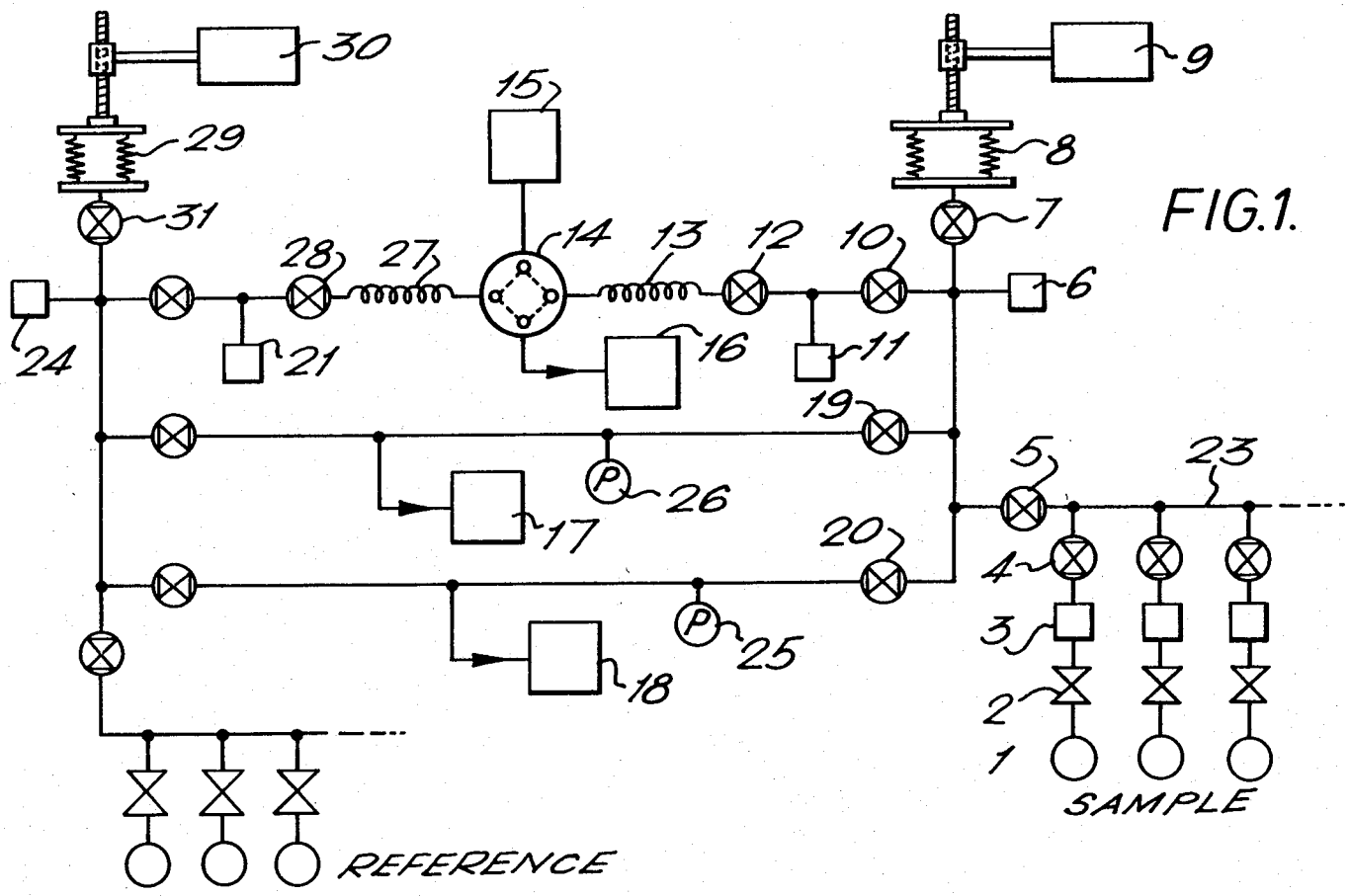
FIG. 1 shows a mass spectrometer gas inlet system according to the invention.

Referring first to FIG. 1, it will be seen that the inlet system comprises two identical halves, connected via a changeover valve 14. In the position shown, sample gas flows through restriction 13 into the source 15, whilst reference gas flows through the restrictor 27 into waste pumping system 16. When valve 14 is changed to the "reference" position, the connections are reversed. Pressures in each inlet system can be equalised by variable volume reservoirs 8 and 29, controlled by motors 9 and 30 respectively. These reservoirs are employed only in the conventional mode of operation.

In use, sample vessels 1 with integral manual valves 2 are connected via couplings 3 to isolation valves 4 to manifold 23. The operator attaches the sample vessels, (and reference sample vessels) and evacuates all pipe work up to valve 2 using mechanical pump 18 through valve 20, then high vacuum pump 17 via valve 19. Valves 4 are then closed and the operator opens all the valves 2 on the sample vessels. The rest of the procedure is carried out automatically. Valve 4 on the first sample inlet is opened to expand the contents of the vessel through valve 5 into the small volume bounded by valves 20, 19, 10, 7 and pressure transducer 6. Transducer 6 must be of a low internal volume, be chemically inert, and introduce negligible volume change as it operates. Several commonly available types are suitable, such as those based on strain gauges or the varying inductance of a coil with a core connected to a diaphragm. The digital computer controlling the operation is fed with the signal from transducer 6, and if the pressure is higher than a value previously given to the computer, the mode of operation will be switched to the conventional method, using bellows 8 and motor drive 9 to adjust the pressure in the inlet. This mode need not be described further. If the pressure indicated by transducer 6 is lower than the predetermined value, then the automatic cold trap mode is selected, and the sample is expanded through valve 10 into auto cold trap 11. The volume of trap 11 and valves 10 and 12 is kept to the minimum possible, preferably less than 1 cc. The trap 11 is then automatically cooled in the manner described below, and all the sample contained in vessel 1 is condensed into trap 11. With the form of trap described, this may take between 3 and 5 minutes. The temperature of trap 11 is maintained at the value most suitable for condensing the sample gas, e.g. about −130° C. for $CO_2$ samples. At this temperature, the vapour pressure of $CO_2$ is about 0.003 of an atmosphere, which is sufficiently low to avoid significant errors due to the different condensation rates of the different $CO_2$ isotopes. Any lower temperature will simply increase the time needed to cool the trap without improving the accuracy of the results, whilst a higher temperature may introduce errors, as explained. Other temperatures will be more suitable for different samples. After the appropriate time has elapsed, valve 5 is closed and any residual non-condensable gas is pumped away via valves 19 and 10. Valve 10 is then closed, and the trap is heated and maintained at about 20° C. (in the case of $CO_2$) so that the sample becomes gaseous. Valve 12 is then opened to allow the sample to leak through restriction 13 and valve 14 into the mass spectrometer source 15. Whilst the unknown sample is being condensed in trap 11, the reference sample may be condensed in trap 21, and this trap is then heated so that reference gas can flow through restrictor 27 and the other port of valve 14 to waste pumping system 16. Alternatively, the conventional inlet system may be used to admit the reference gas because it is generally available in larger quantities.

The isotopic ratio measurements are then made alternatively on sample gas and reference gas by changing valve 14 until a sufficient number of measurements have been made to ensure the required accuracy. The entire inlet system is then evacuated, first by rough vacuum pump 18 and valve 20, then high vacuum pump 17 and valve 19, using pressure gauges 25 and 26 to ensure that the valves are operated at suitable pressures. Traps 11 and 21 may then be heated to 100° C. to remove any contaminating material whilst being pumped by the high vacuum pump, valves 19, and 20 are closed and the trap cooled to room temperature. The analysis of the second sample can then commence.

Figure 2:
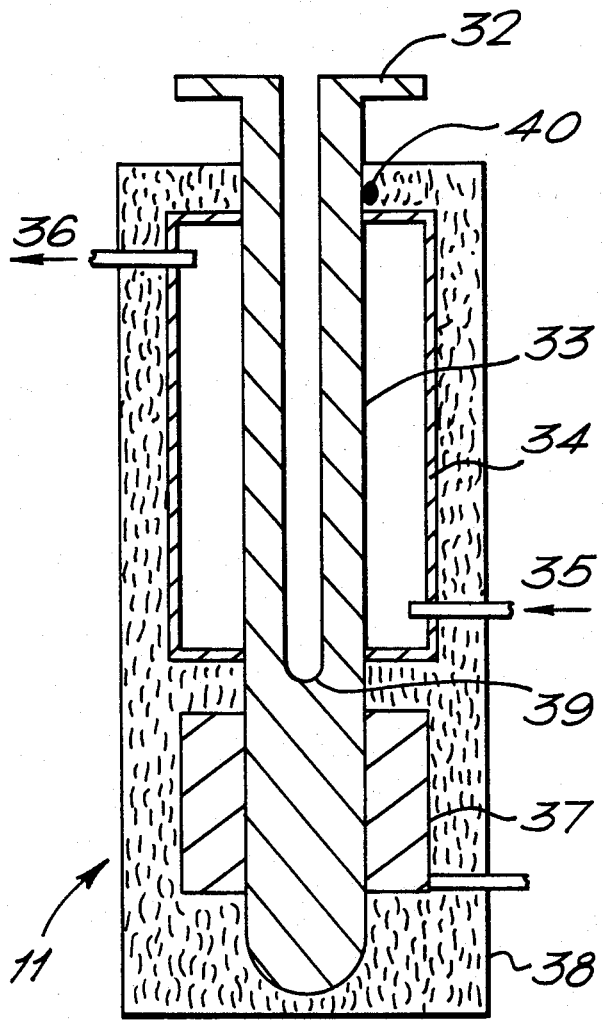
FIG. 2 illustrates the construction of an automatic cold trap of the system of FIG. 1.

A possible method of construction of the automatic cold traps is shown in FIG. 2. A thick walled tube 33, made of stainless steel, or preferably an inert metallic material which is a good thermal conductor, such as nickel, is attached to the inlet system by flange 32. Its narrow bore extends only about two thirds down the tube, to point 39, and the internal volume should be less than 0.5 cc. The upper part of tube 33 is surrounded by jacket 34, through which a suitable refrigerant such as liquid nitrogen can enter through inlet 35 and leave through outlet 36. The lower part of tube 33 is surrounded by heater 37. The entire trap is surrounded by an insulated jacket 38, and the temperature at the top of the trap is monitored by thermocouple 40.

Figure 3:
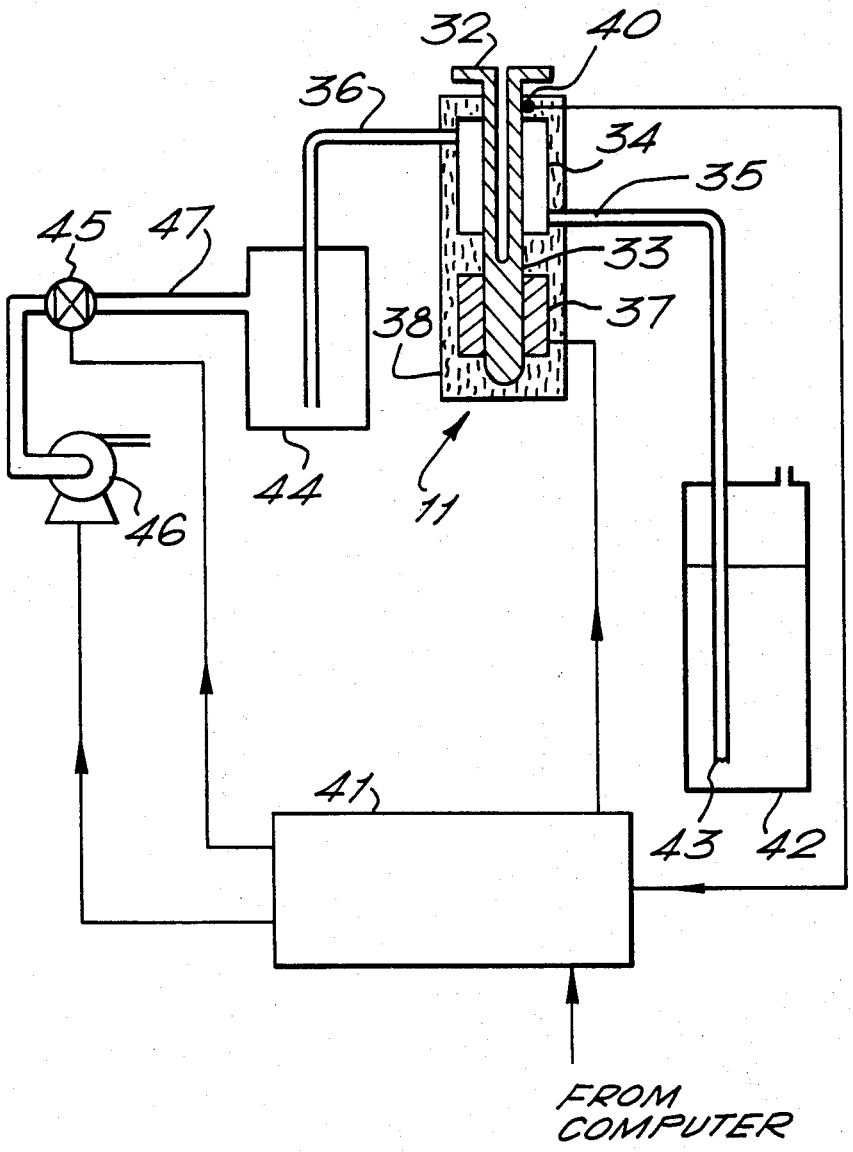
FIG. 3 shows how the cold trap is connected and controlled.

The method in which the cold trap is operated, and the connection of its auxiliary equipment, is shown in FIG. 3. The refrigerant, which is conveniently liquid nitrogen, is stored in vessel 42. It is caused to enter jacket 34 by applying a slight vacuum to pipe 36 from diaphragm pump 46, heat exchanger 44, and solenoid valve 45. A filter 43 protects the system from solid particles which might accumulate in reservoir 42.

When the trap is required to be cooled, valve 45 is opened by controller 41, causing liquid nitrogen to enter jacket 34. When the jacket is full, some nitrogen may enter heat exchanger 44, but the falling trap temperature monitored by thermocouple 40 causes controller 41 to close valve 45 before the exchanger 44 is full, so that no liquefied gas enters valve 45 or pump 46. Exchanger 44 is constructed from copper or another good thermal conductor, so that most of the liquid entering it is vaporized. The temperature in the trap is then controlled by controller 41 opening and closing valve 45 to regulate the flow of liquid gas into the jacket 34 so that the temperature indicated on thermocouple 40 is maintained at a constant value. If the rate of heating of the trap is too low for a satisfactory control action, at the required temperature, heat is applied to the tube 33 by heater 37, which is also controlled by controller 41. By this means the rate of cooling of the trap can be made very rapid, and the final temperature controlled to within ±5° C. When it is required to warm the trap to vaporize the condensed sample, valve 45 is closed and heater 37 used to rapidly vaporize any remaining liquid nitrogen, which will be expelled back into reservoir 42 by the expanding gas in jacket 34. Alternatively, an automatically operated air vent valve can be fitted to outlet 47 to admit air so that any expanding gas in line 36 does not bubble back through reservoir 42 causing unnecessary evaporation. The temperature of the trap is then controlled by regulating the power in heater coil 37 in a conventional manner; should the desired temperature be slightly lower than ambient, some refrigerant can be introduced into jacket 34 by opening valve 45 for a short time.

This method of controlling the admission of refrigerant into the cold trap jacket has been found more controllable than the more obvious method of simply pressurising vessel 42, leading to faster cooling times and more stable temperatures than can be achieved by that method.

It will be appreciated that the functions of controller 41, which might consist of conventional analogue electronic circuits, might in many cases be taken over by the digital computer used to control the entire inlet system, or perhaps a satellite computer, based on a microprocessor, and controlled by the main computer, could be used.

Finally, the whole trap can be heated to about 100° C. by emptying jacket 34 and applying full power to heater 37. This can be used to provide automatic bake out of the trap to remove any contaminating materials before the next sample is introduced.

Figure 4:
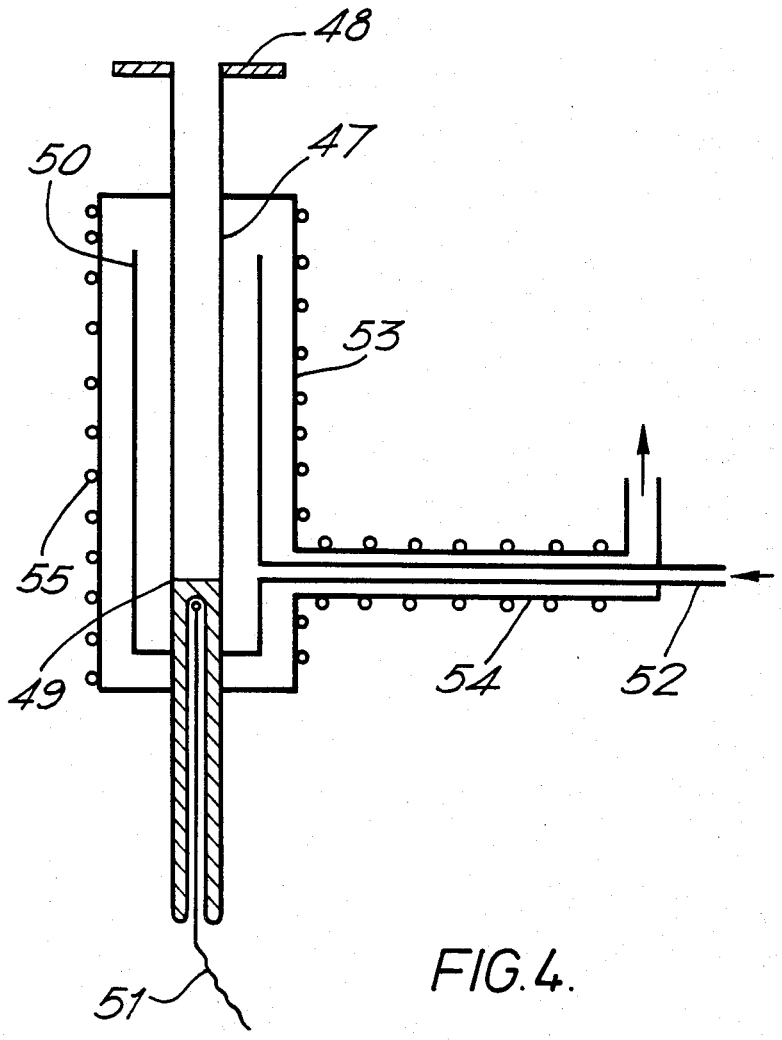
FIG. 4 illustrates the construction of a further embodiment of a cold trap for the system of FIG. 1.

Another form of cold trap suitable for use in the invention, which is especially suitable for use with liquefied gas coolants, is shown in FIG. 4. It consists of a thin walled tube 47, typically made from stainless steel, which is attached to the inlet system by flange 48. Tube 49 is closed off by diaphragm 49, and is surrounded by an inner vessel 50, which is open at the top, as shown. A thermocouple 51 is inserted into the lower part of tube 47, which has a narrower bore than the top section, so that its hot junction is adjacent to diaphragm 49. Liquid coolant enters the bottom of inner vessel 50 via pipe 52, and cools the tube 47. Evaporating coolant, which is a gas at low temperature, escapes from vessel 50 and fills outer vessel 53. Inlet pipe 52 is concentrically surrounded by another pipe 54 which is connected to the lower part of outer vessel 53. Pipe 54 serves as an outlet for the coolant and is connected to pump 46 (FIG. 3) via a valve 45, if desired. The outer wall of vessel 53 and pipe 54 is wound with an electrical heating element 55 which is usually energized at low power even when coolant is flowing through the trap. This results in vaporization of any liquid coolant which might enter the outer vessel 53 from inner vessel 50, and ensures that only gaseous coolant leaves the outlet pipe 54. Heat exchanger 44 (FIG. 3) between the trap outlet and pump 46 is therefore not required with this embodiment and can be omitted. In addition, the cold gas surrounding inner vessel 50 serves as a thermal insulator, and prevents excessive loss of coolant by premature evaporation, and because the temperature of the wall of the outer vessel 53 is maintained above the surrounding temperature by heater 55, even when coolant is flowing, the condensation of water from the atmosphere is eliminated. In other respects, the operation of this type of trap is similar to the embodiment described previously, full power being applied to the heater when it is desired to bake the trap or vaporize the sample rapidly.

We claim:

1. A mass spectrometer adapted for the accurate determination of the isotopic composition of an at least partially condensable gaseous sample, said mass spectrometer having an ion source and an inlet system comprising:

(a) means for allowing said sample to expand from a reservoir into said inlet system;

(b) means for determining the pressure of said sample in said inlet system;

(c) means for allowing said sample to expand further into said ion source when said pressure of said sample is greater than a predetermined pressure;

(d) a coolable vessel provided with cooling means for condensing substantially all of the condensable portion of said sample into said coolable vessel when said pressure of said sample is less than said predetermined pressure, said cooling means comprising a coolant passage disposed around said coolable vessel, pumping means for drawing a coolant through said passage, means for vapourising said coolant before it reaches said pumping means, and means for stopping the flow of coolant through said passage;

(e) means for isolating said coolable vessel from said reservoir after said condensable portion of said sample has been condensed in said coolable vessel;

(f) means for vapourising in said inlet system after said reservoir has been isolated from said coolable vessel the portion of said sample condensed in said coolable vessel; and (g) means for allowing said vapourised sample portion to expand further into said ion source.

2. A mass spectrometer according to claim 1 having a control means which causes the pressure determined in said inlet system to be compared with said predetermined pressure and which, if said pressure determined in said inlet system is less than said predetermined pressure, causes in sequence:

(a) said pumping means to operate to draw said coolant through said passage;

(b) said means for isolating to operate to isolate said reservoir from said coolable vessel;

(c) said means for stopping the flow of coolant to operate to stop the flow of said coolant through said passage, thereby permitting vapourisation of the portion of said sample condensed in said coolable vessel; and (d) said means for allowing said vapourised sample portion to expand further to operate to allow said vapourised sample portion to expand into said ion source.

3. A mass spectrometer according to claim 2 wherein a control valve is disposed between said pumping means and said means for vapourising said coolant, and said control means is adapted to operate said control valve to cause coolant to be drawn through said passage as required.

4. A mass spectrometer according to claim 3 further provided with a temperature sensing means attached to said coolable vessel and a regulating means for maintaining the temperature of said coolable vessel at a desired value and which is arranged to receive signals indicative of the temperature of said coolable vessel from said temperature sensing means and to cause said control valve to adjust the flow of said coolant through said passage to maintain the temperature of said coolant vessel at said desired value.

5. A mass spectrometer according to claim 1 in which said inlet system is further provided with a vacuum pump means adapted to evacuate said coolable vessel after said condensable portion of said sample has been condensed in said coolable vessel but before said condensable portion is vapourised, thereby to remove non-condensable constituents of said sample.

6. A mass spectrometer according to claim 2 in which said inlet system is further provided with a vacuum pumping means adapted to evacuate said coolable vessel after said condensable portion of said sample has been condensed in said coolable vessel but before said condensable portion is vapourised, thereby to remove non-condensable constitutents of said sample.

7. A mass spectrometer according to claim 1 further comprising a second inlet system for admitting a reference sample and a change-over means adapted to permit either said inlet system or said second inlet system to be connected to said ion source, said second inlet system being substantially identical to said inlet system.

8. A mass spectrometer according to claim 6 wherein said control means is further adapted to cause:

(a) the condensable portion of said sample to be condensed in said coolable vessel when said pressure of said sample in said inlet system is greater than said predetermined pressure before said means for allowing said sample to expand further into said ion source is operated;

(b) the fall in the pressure of said sample in said inlet system due to condensation of a condensable portion of said sample to be compared with a second predetermined pressure; and (c) if said fall in pressure is greater than said second predetermined pressure, the portion of said sample condensed in said coolable vessel to be vapourished and said means for allowing said sample to expand further into said ion source to operate; or (d) if said fall in pressure is less than said second predetermined pressure, (i) said vacuum pumping means to evacuate said coolable vessel whilst a flow of coolant through said passage is maintained, (ii) said means for isolating said coolable vessel to operate to isolate therefrom said reservoir, (iii) said means for vapourising the condensed portion of said sample to operate, and (iv) said means for allowing said vapourised sample portion to expand further into said ion source to operate.

9. A mass spectrometer according to claim 1 for use with a coolant consisting of a liquefied gas, wherein said passage includes an inner vessel surrounding said coolable vessel and open at its upper end and substantially enclosed by an outer vessel from which said coolant is withdrawn after passing through said passage.

10. A mass spectrometer according to claim 9 wherein said outer vessel is provided with a heating means capable of ensuring the vapourisation of any liquid coolant entering said outer vessel.

* * * * *